United States Patent [19]

Meguro et al.

[11] 4,425,555

[45] Jan. 10, 1984

[54] DIELECTRIC FILTER MODULE

[75] Inventors: Takeshi Meguro; Yukio Ito, both of Kawasaki, Japan

[73] Assignee: Fujitsu Limited, Kawasaki, Japan

[21] Appl. No.: 314,428

[22] Filed: Oct. 23, 1981

[30] Foreign Application Priority Data

Oct. 30, 1980 [JP] Japan ..... 55-154103[U]

[51] Int. Cl.[3] ..... H01P 1/208; H01P 7/04

[52] U.S. Cl. ..... 333/202; 333/209; 333/212; 333/232

[58] Field of Search ..... 333/202–212, 333/245, 248, 221–230, 235, 231, 239; 29/600; 334/85

[56] References Cited

U.S. PATENT DOCUMENTS

| | | | |
|---|---|---|---|
| 3,324,224 | 6/1967 | Thibodeau | 333/12 |
| 3,505,618 | 4/1970 | McKee | 333/209 X |
| 3,955,161 | 5/1976 | Mac Turk | 333/209 |
| 4,291,288 | 9/1981 | Young et al. | 333/248 |

*Primary Examiner*—Marvin L. Nussbaum
*Attorney, Agent, or Firm*—Staas & Halsey

[57] ABSTRACT

A dielectric filter module having an open housing which supports screws for adjusting the characteristics of the dielectric filter. The dielectric filter, which includes an elongated dielectric block having internal cavities and a conductive film extending from the exterior surface of the block into the internal cavities, is mounted in an openended metal housing which surrounds three sides of the dielectric filter. Suitable housings can be inexpensively fabricated to the necessary length from segments cut from commercially available channel members having C-shaped or I-shaped cross-sections. Wires extend through the open ends of the housing to connector elements on the surface of the block adjacent its ends. The connector elements can be adhesively secured metal members or locally deposited regions of metallic film. Either threaded holes on the housing or nut members mounted on the housing can be used for supporting the adjustment screws.

10 Claims, 5 Drawing Figures

DIELECTRIC FILTER MODULE

CROSS REFERENCE TO RELATED APPLICATION

The present application is related to a co-pending U.S. application Ser. No. 279,461, filed July 1, 1981, now U.S. Pat. No. 4,410,868, and assigned to the Assignee of the present application.

BACKGROUND OF THE INVENTION

The present invention relates to a dielectric filter module which is stable both mechanically and electrically, and particularly to a dielectric filter module employing a metalized dielectric block mounted within an open housing which supports adjustment screws for adjusting the characteristics of the filter.

The frequencies which are used in mobile communication systems has been raised from the VHF band to the UHF band and then to the microwave band, in order to meet the demand for a greater number of channels. The equipment used in such mobile radio communication systems is preferably small, lightweight, and economical. To help satisfy these requirements, the aforesaid related application proposes several embodiments of a small and rugged dielectric filter.

FIG. 1 illustrates an embodiment of the dielectric filter 10 of the aforesaid related application. Filter 10 has the trans-mission characteristics of a six-section Tchbyscheff filter having a resonance frequency of 876 MHz. Dielectric block 12 is generally brick-shaped, being about 80 millemeters long, 13.5 millemeters high, and 13.5 millemeters thick, and is made, for example, from Ti-Ba ceramic. The dielectric constant of block 12 is large. Six cylindrical resonator cavities 14 extend through block 12 from the top surface 16 to the bottom surface 18 thereof. A conductive film 20 is deposited on the inside surfaces of cavities 14 and extends to the outer surface of block 12, covering bottom surface 18, side surface 22, and opposite side surface 24. A suitable conductive film can be obtained by depositing an Ag-Pt film conductor about 15 mm thick to metalize the interior and exterior surfaces indicated. Top 16 and ends 26 of block 12 are not metalized. Metalizing the interior and exterior surface of block 12 in this way provides six quarter-wave resonators in which top surface 16 is an open plane and bottom surface 18 is a short-circuit plane. Since the dielectric constant of block 12 is large, the resonant electromagnetic field energy is mostly confined within block 12, which acts as a dielectric filter, and the external metalization provides a degree of electromagnetic shielding on three sides. Five cylindrical coupling adjustment cavities 27 are provided in block 12 between resonator cavities 14, the cavities 27 not being metalized.

With continuing reference to FIG. 1, block 12 is electrically and mechanically affixed within metal case 28 as by soldering. The ends of metal case 28 have holes 30 for receiving input/output connectors 32, which are secured to case 28 by screws 34. Input/output conductors 32 are electrically connected to block 12 via wires 36, which are connected to metal rods 38 inserted into cylindrical cavities 40 adjacent the ends 26 of block 12.

With continuing reference to FIG. 1, top surface 16 of block 12 is an open plane on which no metalized film has been deposited, so a very small quantity of electromagnetic field energy is emitted. Case 28 is therefore sealed by metal lid 42, which is secured to case 28 by screws 44. Six frequency adjustment screws 46 extend through lid 42, each screw 46 being positioned with respect to its corresponding resonator cavity 14 to permit fine control of the resonance frequency by effectively varying the length of the cavities. Similarly, five coupling adjustment screws 48 extend through lid 42 and are positioned coaxially with respect to their corresponding coupling adjustment cavities 27, thereby permitting fine adjustment of the coupling between the resonators.

As is explained in the aforesaid related application, which is incorporated herein by reference, the filter of FIG. 1 can be employed as a filter or antenna duplexer for separating transmitting and receiving waves for mobile radio equipment, so that an antenna may be used common. Filter 10 can be modified in a number of ways; for example, resonator cavities 14 need not extend entirely through block 12 and may be metalized for only a portion of their lengths, and the configurations and positions of coupling adjustment cavities 27 can be varied. Adjustment screws of metal or insulating material may be used. Moreover, in many applications a six resonator filter may not be needed, so that the number of cavities 14 and 27 and their corresponding screws 46 and 48 can be reduced. Such a simplification in structure is desirable for mobile communication systems, when electrical parameters permit, but due to financial considerations the weight and expense of metal case 28, lid 42, and screws 44 generally must remain unchanged in practice in spite of the decreased physical dimensions of the dielectric filter itself. That is, manufacturing economics may mandate that case 28 be available in only a limited number of sizes even if this means that the filter modules have cases that are larger than necessary. This is an obstacle to the mass production of light, inexpensive communication equipment.

SUMMARY OF THE INVENTION

Accordingly, it is the primary object of the present invention to provide a dielectric filter module which is easy to manufacture, inexpensive, small, light, and stable both mechanically and electrically.

Another object of the invention is to provide a dielectric filter module having a housing which relies both upon the metalization of the dielectric filter block and the metal of the transmitter/receiver cabinet itself to provide part of the necessary shielding.

Another object of the present invention is to provide a dielectric filter module having a housing which supports the adjustment screws but which can nevertheless be readily fabricated in a variety of lengths, depending upon the physical requirements of the dielectric filter itself.

Another object of the present invention is to provide a dielectric filter module having a housing which can be fabricated from a segment cut from a rod-like, commercially available channel member.

Briefly stated, these and other objects can be obtained by mounting the dielectric block within a cavity in an open metal housing of simple configuration, the housing having a portion thereof extending over the upper surface of the dielectric block and supporting the adjustment screws. Commercially available channel members having elongated recesses therein are well-suited for this use, and can be cut to the needed length.

DESCRIPTION OF THE PREFERRED EMBODIMENTS

Figure 1:
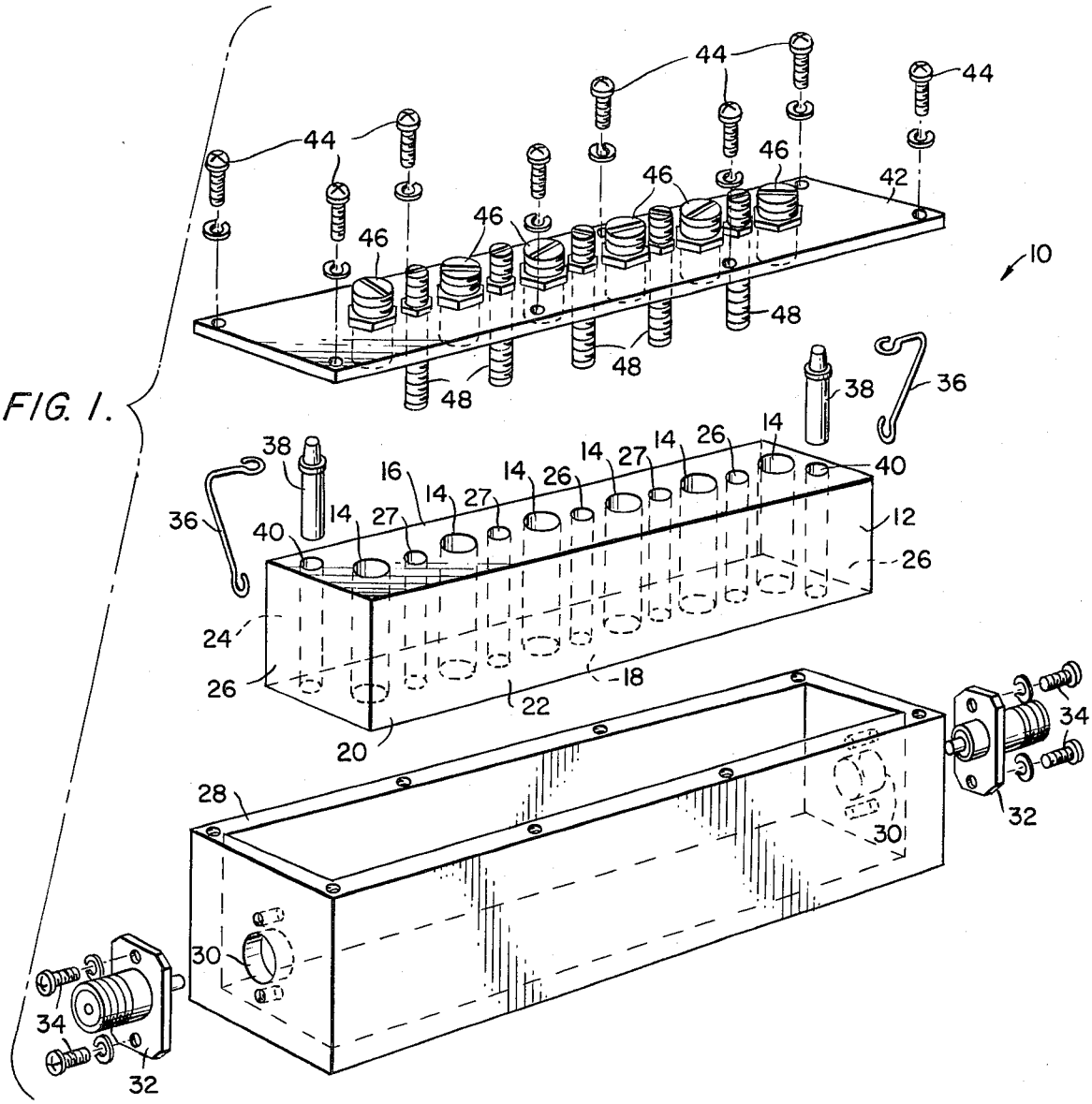
FIG. 1 is an exploded perspective view illustrating a dielectric filter module disclosed in a related co-pending application.
Figure 2:
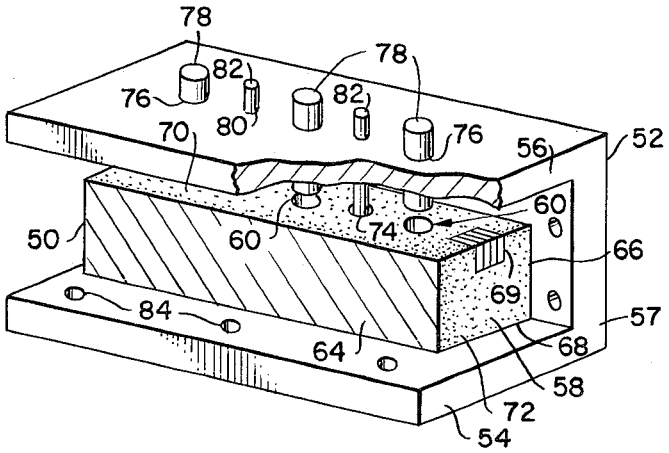
FIG. 2 is a partially cut-away perspective view of filter module of the present invention, wherein the dielectric block is mounted in an open housing.

The filter module illustrated in FIG. 1 employs a closed housing which provides additional shielding for the dielectric block, but it may be economically advantageous to reply upon the transmitters/receiver cabinet itself as part of the shielding. This permits a filter module to be made using a housing less expensive than the one illustrated in FIG. 1. FIG. 2, for example, illustrates a three-stage dielectric filter module wherein a dielectric filter 50 is mounted in an open housing 52. Housing 52 is a unitary structure consisting of bottom plate 54, top plate 56, and back plate 57. Housing 52 is preferably fabricated out of a segment cut from a metal rod-like channel member, produced by drawing or die casting, etc. This is financially advantageous since suitable channel members are available commercially.

With continuing reference to FIG. 2, dielectric filter 50 consists of a generally brick-shaped dielectric block 58 bonded to housing 52. Block 58 has three resonator cavities 60 (although only two are illustrated in the cut-away view of FIG. 2) whose internal surfaces are metalized to provide a conductive film 62 (see FIG. 5). The front surface 64, back surface 66, and bottom surface 68 are also metalized, thereby providing a conductive film extending on three sides of block 58 and into the resonator cavities 60. A metal connector element 69 is adhesively secured at each end of block 58 (only one connector element 69 is illustrated in FIG. 2) to provide electrical connection to dielectric filter 50. Alternately connector elements 69 may simply be locally metalized regions at the ends of block 50. Top surface 70 and the two end surfaces 72 of block 50 are not metalized. If desired for additional shielding, however, surfaces 70 and 72 may also be partially metalized, leaving an exposed region for isolation of connector elements 69. Two un-metalized coupling adjustment cavities 74 (only one is illustrated in the cut-away view of FIG. 2) are provided in block 50 between holes 60.

With continuing reference to FIG. 2, three threaded screw holes 76 are provided in top plate 56 to accommodate metal screws 78, which are positioned to screw into metalized cavities 60 in order to permit fine adjustment of the resonant frequency by varying the fringing capacitance between the screw and the resonator. Top plate 56 also has two threaded screw holes 80 to accommodate metal screws 82, which are positioned to screw into cavities 74 for fine adjustment of the coupling. Housing 52 is also provided with threaded screw holes 84 for mounting the module in the transmitter/receiver cabinet. Although FIG. 2 illustrates holes 84 along the periphery of bottom plate 54 and back plate 57 they may, of course, be provided wherever they are needed.

Figure 3:
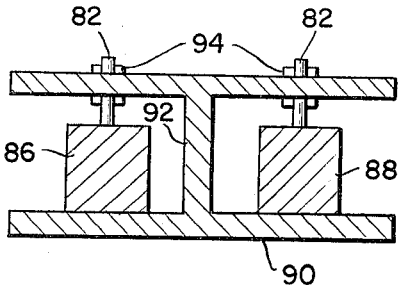
FIG. 3 is a sectional view of a filter module having separate dielectric filters for transmitting and receiving, the filters being mounted in an open housing having an I-shaped section rather than the C-shaped section of FIG. 2.

FIG. 3 illustrates an embodiment of the filter module having a first filter 86 for transmitting and a second filter 88 for receiving. Whereas the filter module of FIG. 2 used a housing 50 fabricated out of a segment cut from a metal channel member having a C-shaped cross section, the housing 90 of the module of FIG. 3 is fabricated from a metal channel member having an I-shaped cross section. This provides a channel member having two cavities separated by a metal plate 92 to shield filters 86 and 88 from each other. In the embodiment of FIG. 3 the holes for adjusting screws 78 and 82 are not threaded. Instead, the holes accommodate nut members 94, which permit adjustment of the screws.

Figure 4:
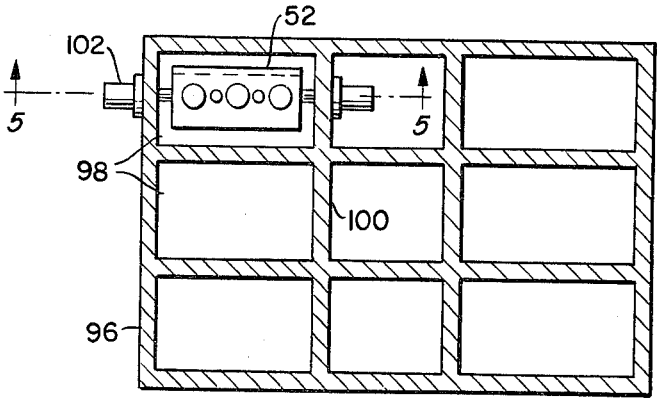
FIG. 4 is a sectional view showing the module of FIG. 2 installed in the upper part of a transmitter/-receiver cabinet.

FIG. 4 illustrates the filter module of FIG. 2 mounted in the cabinet 96 of a transmitter/receiver. Cabinet 96 is divided into several isolated chambers 98 by metal isolation walls 100, thereby shielding chambers 98 from one another. The filter module is mounted in one of the isolated chambers 98 by screwing it to the outer walls of cabinet 96 or the isolation walls 100, and input/output connectors 102 are provided for electrical connection to the filter module. It is to be understood that the remaining isolated chambers 98 are not empty, as illustrated in FIG. 4, but contain circuitry for the transmitter/receiver.

Figure 5:
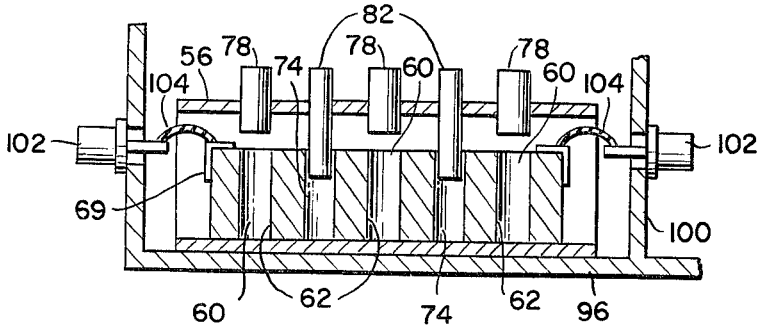
FIG. 5 is a sectional view taken along line 5—5 of FIG. 4.

FIG. 5 represents a sectional view taken along the line 5—5 of FIG. 4. Input/output connectors 102 are secured to the walls of cabinet 96 and are electrically connected to connector elements 69 by conductive ribbons 104. With the module mounted as illustrated in FIGS. 4 and 5, it will be apparent that screws 78 are easily accessible for adjusting the resonance frequency of the module and that screws 82 are readily accessible for adjusting the coupling.

It will be apparent that any modifications and variations may be effected without departing from the scope of the novel concepts of the present invention.

What we claim is:

1. A dielectric filter module, comprising:

an elongated dielectric filter, which includes an elongated dielectric block having a plurality of elongated and substantially parallel cavities opening onto the surface thereof, a conductive film which coats at least part of the exterior surface of the block and at least part of the interior surface of at least one of the cavities, input/output means for introducing radio frequency energy into the block and for withdrawing radio frequency energy from the block, and a plurality of screws each movable along the axis of a corresponding cavity to adjust the filter characteristics; and an open housing within which the dielectric filter is mounted, the open housing comprising a first elongated plate, a second elongated plate spaced apart from the first elongated plate and substantially parallel thereto, and a third elongated plate connecting the first and second elongated plates, the dielectric filter being mounted between the first and second plates with the axes of the cavities therein passing through at least one of the three plates, said at least one of the three plates through which the axes of the cavities pass having a plurality of holes therein through which the adjustment screws movably extend.

2. The dielectric filter module of claim 1, wherein the input/output means comprises a pair of connector elements each affixed to the surface of the block adjacent either end thereof, and a pair of elongated conductors, one end of each elongated conductor being electrically connected to one of the connector elements.

3. The dielectric filter module of claim 2, wherein the connector elements are metal members adhesively secured to the block.

4. The dielectric filter module of claim 3, wherein the connector elements are metal films deposited on the surface of the block.

5. The dielectric filter module of claim 3 or 4, wherein the first, second, and third plates comprise a unitary piece of metal.

6. The dielectric filter module of claim 5, wherein the unitary piece of metal comprises a segment of an elongated rod-like channel member having an elongated cavity in which the dielectric filter module is mounted.

7. The dielectric filter module of claim 6, wherein the holes in the plate through which the screws pass are threaded.

8. The dielectric filter module of claim 6, wherein the holes in the plate through which the screws pass are not threaded, and further comprising nut member means mounted on the plate through which the screws pass for movably supporting the screws.

9. The dielectric filter module of claim 6, wherein the segment of channel member has a generally C-shaped cross-section.

10. The dielectric filter module of claim 6, wherein the segment of channel member has a generally I-shaped cross-section, the module having two dielectric filters mounted substantially parallel to one another on either side of the central portion of the I.

* * * * *